United States Patent [19]

Rapp, deceased et al.

[11] Patent Number: 4,712,530

[45] Date of Patent: Dec. 15, 1987

[54] HYDRAULIC ADJUSTING ARRANGEMENT FOR AN INJECTION PUMP

[75] Inventors: Wolfgang Rapp, deceased, late of Esslingen, Fed. Rep. of Germany, by Gisela Rapp, Administratrix; Günther Häfner, Berglen; Ulrich Letsche, Stuttgart, both of Fed. Rep. of Germany

[73] Assignee: Daimler-Benz Aktiengesellschaft, Stuttgart, Fed. Rep. of Germany

[21] Appl. No.: 794,286

[22] Filed: Nov. 4, 1985

[30] Foreign Application Priority Data

Nov. 2, 1984 [DE] Fed. Rep. of Germany ..... 3440055

[51] Int. Cl.[4] ..... F02M 59/20

[52] U.S. Cl. ..... 123/502; 464/2

[58] Field of Search ..... 123/501, 502, 90.15; 464/2

[56] References Cited

U.S. PATENT DOCUMENTS

| | | | |
|---|---|---|---|
| 1,871,268 | 8/1932 | Hildebrand | 123/90.15 X |
| 2,950,610 | 8/1960 | Stier | 464/2 |
| 3,004,410 | 10/1961 | Pierce | 464/2 |
| 3,685,499 | 8/1972 | Meacham et al. | 123/90.15 |
| 3,973,540 | 8/1976 | List | 123/502 X |
| 4,304,205 | 12/1981 | Bauer et al. | 464/2 X |
| 4,548,182 | 10/1985 | Kamleitner | 123/502 X |

FOREIGN PATENT DOCUMENTS

| | | | |
|---|---|---|---|
| 774166 | 12/1934 | France | 123/502 |
| 79046 | 5/1984 | Japan | 123/90.15 |

*Primary Examiner*—Tony M. Argenbright

[57] ABSTRACT

This invention relates to a hydraulic adjustment arrangement for the control of the injection start for a motor vehicle internal combustion engine, consisting of a primary part on the side of the internal-combustion engine and a secondary part on the side of the injection pump as well as radial pistons operating as a function of the admission of hydraulic oil, said radial pistons operating as a function of the admission of hydraulic oil, said radial pistons being guided in cylinders contained in the secondary part and interacting with levers extending in a circumferential direction and being pivoted on the secondary side, flexible connectors resting on said levers in one portion and fixed to the primary part on another portion, such that a radial movement of the pistons and as corresponding outward swivel movement of the levers and the flexible connectors causes a rotation of the secondary part relative to the primary part. A low-pressure hydraulic system is sufficient for the operation of the hydraulic adjusting device because the movement of the radial pistons is also supported by the centrifugal forces occurring with increasing speed of the internal-combustion engine.

12 Claims, 3 Drawing Figures

HYDRAULIC ADJUSTING ARRANGEMENT FOR AN INJECTION PUMP

BACKGROUND AND SUMMARY OF THE INVENTION

The present invention relates generally to a timing device, more particularly to a timely adjustment device for the control of the fuel injection start for a motor vehicle internal-combustion engine. Preferred embodiments of the invention relate to an arrangement for controlling the fuel injection start, wherein a connection; having one section fixed to move with a primary part of the transmission and another section positioned to move with a secondary part of the transmission, effects a circumferential rotation of the secondary part with respect to the primary part.

Based on U.S. Pat. No. 3,973,540, a hydraulic adjusting device is known where the rotating movement between the primary part and the secondary part is forced as a function of the admission of pressure medium to the piston via diagonally extending slot guiding means.

Also, a hydraulic adjusting device is known from U.S. Pat. No. 3,685,499 where the axially acting piston is connected with the primary part by an expensive toothing. In this case, the toothing is to permit a rotationally stable connection as well as a relative movement in an axial direction between the primary part and the piston. For the relative rotational movement between the primary and the secondary part, balls are provided as transfer members which are guided in diagonally extending guide grooves.

The invention is based on the objective of creating, in view of the embodiment according to U.S. Pat. No. 3,685,499, a hydraulic adjusting device where a rotation of the secondary part relative to the primary part can take place with little or no hydraulic pressure adjusting angles.

This objective is achieved by the effective direction of the piston as well as the arrangement and development of the transfer members connected with this piston. In the particular embodiment shown in FIGS. 1-3, the flexible connector, which effects circumferential rotation of the second any part with respect to the primary part is comprised of a chain linkage attached to the primary part of the transmission by means of a bolt through one link and positioned with respect to the secondary part of the transmission in such a way that the linkage rests on a lever which is pivotally attached to the secondary part. By these arrangements, operation of the hydraulic timing adjustment arrangement is achieved at a low pressure, such as the engine oil pressure, because the radial movement of the piston as well as the swivel movement of the lever is supported by the centrifugal forces occurring at an increasing speed of the internal-combustion engine.

Further, objects, features, and advantages of the present invention will become more apparent from the following description when taken with the accompanying drawing(s) which show, for purposes of illustration only, an embodiment constructed in accordance with the invention.

BRIEF DESCRIPTIONS OF DRAWINGS

DETAILED DESCRIPTION OF THE DRAWINGS

Figure 1:
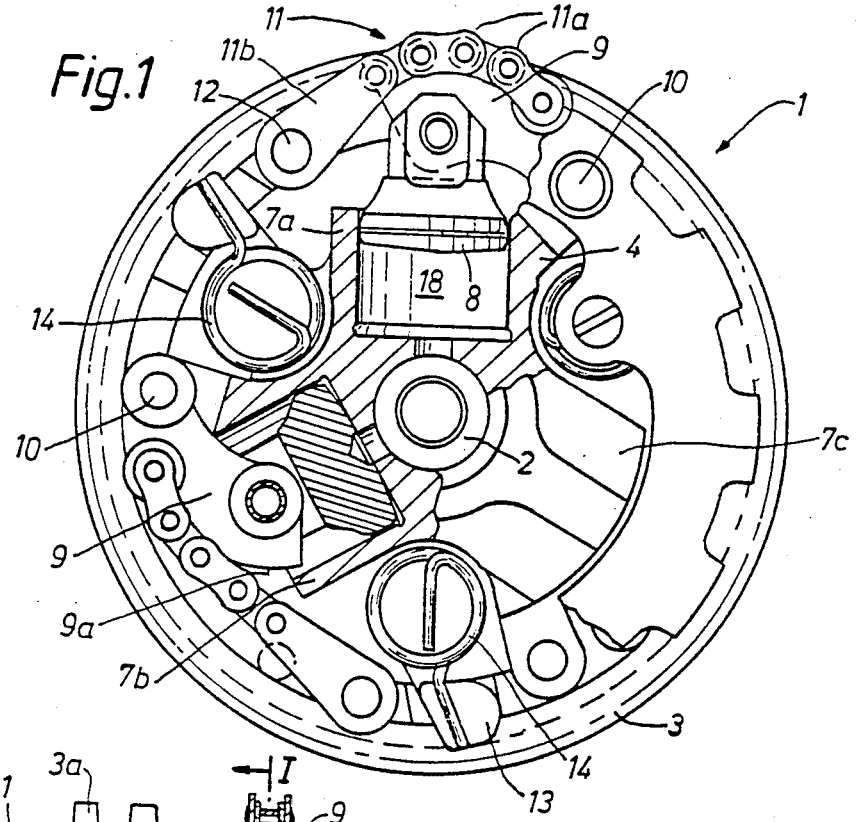
FIG. 1 is a cross section view of the hydraulic timing adjustment arrangement according to the invention, taken at the Line I—I in FIG. 2, where the upper radial pistin is shown in position where pressure is admitted to it, but the lower left radial piston is shown in a position without pressure.

As shown in FIG. 1, a hydraulic timing adjustment arrangement 1 in the embodiment of a radial-piston timing injection mechanism for the control of the fuel injection start for a motor vehicle internal-combustion engine is mounted on the camshaft 2 of a conventional injection pump that is not shown. The arrangmeent consists of a primary part 3 on the drive side and a secondary part 4 on the side of the injection pump.

Figure 2:
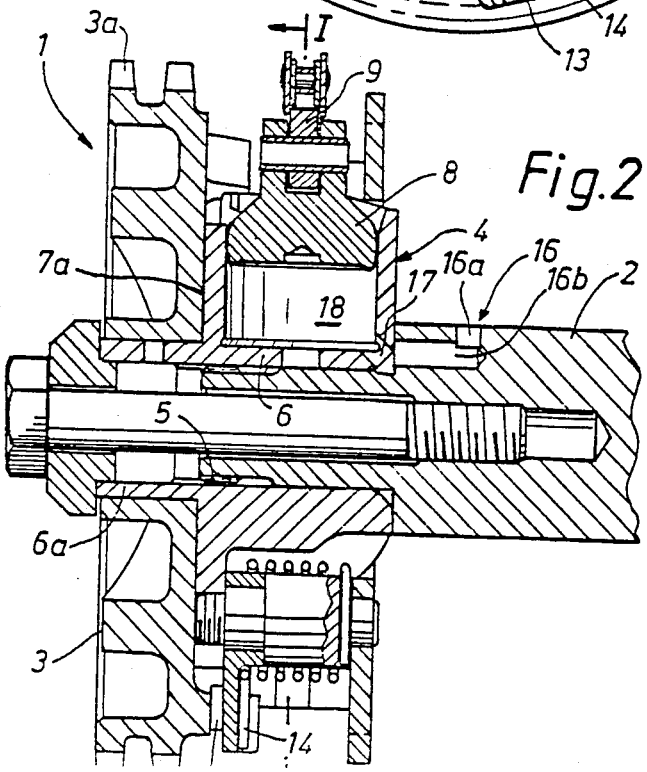
FIG. 2 is a longitudinal sectional view of the hydraulic timing arrangement where the upper radial piston is shown in a position where pressure is admitted to it.
Figure 3:
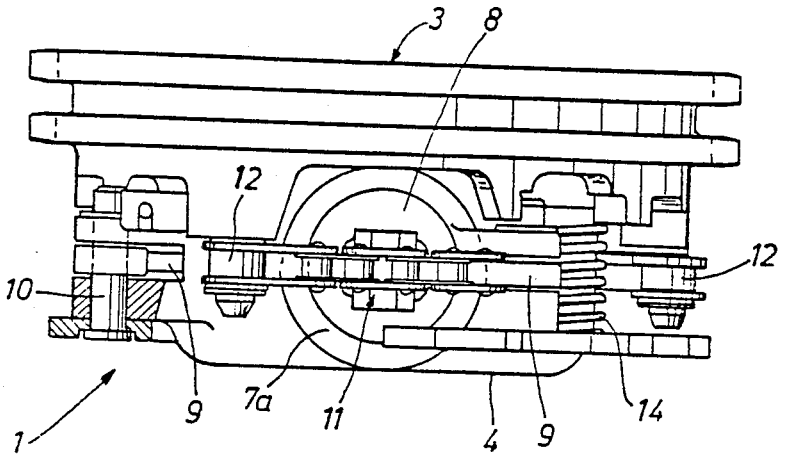
FIG. 3 is a top view of the hydraulic timing adjustment arrangement.

As shown in FIGS. 1 and 2, the secondary part 4 is composed of a bearing sleeve 6 connected with the injection pump shaft 2 by means of spline 5, and a cylinder housing having three cylinders *7a*, *7b*, *7c* evenly distributed in a circumferential direction. Crowned radial pistions 8 are guided within the cylinders, and move in a direction perpendicular to or approximately perpendicular to the axis of the shaft 2.

A lever 9 extending in circumferential direction is pivotally attached to the secondary part by swivel shaft 10 and to a respective radial piston 8. In the close area of the swivel shaft 10, a flexible connector 11 illustrated as a chain piece is rotably fastened to the lever 9. The chain links 11*a* of the flexibile connector 11 complete or partially rest on the arched back 9*a* of the lever 9, depending on the position of the radial piston 8. The free driving arm 11*b* of the flexible connector 11 is fixed to the primary part 3 by means at a bearing bolt 12. The primary part 3 is equipped with a drive toothing 3*a* and is pivoted on a part of the bearing sleeve 6 that projects from the end. The primary part 3 has projections 13 at which pull-back springs 14 support themselves. The pull-back springs 14 are connected with the secondary part 4 and are developed as torsion springs.

The hydraulic timing adjustment arrangement operates as follows.

The three radial pistons 8 are hydraulically operated by hydraulic oil which, via an arrangement 16 of bores, namely a radial bore 16*a* and an axial bore 16*b* in the injection pump shaft 2, and an oil bore 17 in the bearing sleeve 7, is fed to the respective pressure spaces 18 that are defined by the radial pistons 8 and the wall surfaces of the cylinders *7a*, *7b* and *7c*. The radial movement of the radial piston 8 causes a swivel movement of the lever 9 which is pivotally attached to the pistons and to the secondary part. Additionally, the radial movement of the piston 8 and the subsequent movement of the lever 9 due to the hydraulic pressure is supported on the centrifugal forces occurring at an increased speed of the internal combustion engine. In the process, the flexible connectors 11 are forced outward and deformed changing the spacing in the circumferential direction of the bearing points on the primary and the secondary side. The rotation of the primary part and the secondary part with respect to one another causes a rotation of the injection pump shaft 2 which corresponds to a change of the injection start. In the case of a pressure relief of the piston 8, the torsion springs 14, which act against the force of the upward moving radial pistons 8, cause the readjustment of the secondary part relative to the primary part back into the starting position.

The inflow or the outflow of the hydraulic oil to the radial piston is controlled via a servo valve that is controlled by an electronic regulating system which is connected to the motor oil circulating system (not shown). Thus, the actual value of the adjusting angle corresponds to the desired value determined by the electronic regulating system according to speed, load and temperature.

We claim:

1. A hydraulic timing adjustment arrangement linking a primary and a secondary part of a transmission for driving a fuel injector system for a motor vehicle internal combustion engine, said arrangement comprising:

a flexible connector means having one section fixed to move with the primary part and another section fixed to move with the secondary part movable means on the secondary part adjacent to said connector means for deforming said flexible connector means radially to effect a circumferential rotation of the secondary part with respect to the primary part.

2. A timing adjustment arrangement according to claim 1, said moveable means comprising at least one radial piston in a cylinder.

3. A hydraulic timing adjustment arrangement according to claim 2, wherein the radial piston is guided in a cylinder of the secondary part and is crowned.

4. A hydraulic timing adjustment arrangement according to claim 2, including a bearing sleeve that is rotationally disposed on the injection pump shaft and is unitary with said cylinder.

5. A hydraulic timing adjustment arrangement according to claim 4, wherein the primary part is rotatably disposed on a part of the bearing sleeve that projects from the end.

6. A hydraulic timing adjustment arrangement according to claim 1, wherein the primary part has a drive toothing.

7. A hydraulic timing adjustment arrangement according to claim 1, wherein said flexible connector means is comprised of a multi-link chain.

8. A hydraulic timing adjustment arrangement according to claim 2, wherein the flexible connector means includes a chain link and a driving arm, said movable means includes a lever means connected to said radial piston and said secondary part adjacent to said connector means such that in the case of a maximum admission of pressure to the radial piston, the chain link , completely rests on the arched back of the lever means, while the driving arm projects beyond the lever means and is fixed at the primary part.

9. A hydraulic timing adjustment arrangement according to claim 1, including a spring means connected to the primary part and the secondary part, for acting against the force of said movable means.

10. A hydraulic timing device according to claim 9, wherein said spring means includes a torsion spring connected between said primary and secondary part for biasing said primary and secondary parts circumferentially to an initial angular position relative to each other.

11. A hydraulic timing adjustment arrangement according to claim 2, wherein the bearing sleeve of the secondary part has an oil bore which connects a pressure space, defined by the walls of the cylinder, with an arrangement of bores in the injection pump shaft.

12. A hydraulic adjustment arrangement according to claim 2, having three radial pistons positioned equal distances from each other in a circumferential direction.

* * * * *